US008292449B2

(12) United States Patent
Poissonnet et al.

(10) Patent No.: US 8,292,449 B2
(45) Date of Patent: Oct. 23, 2012

(54) MODULAR LAMP FOR ILLUMINATING A HAZARDOUS UNDERWATER ENVIRONMENT

(75) Inventors: Cyril Poissonnet, San Diego, CA (US); Mario de la Cruz, Chula Vista, CA (US); Edward Petit de Mange, San Diego, CA (US)

(73) Assignee: Remote Ocean Systems, Inc., San Diego, CA (US)

( * ) Notice: Subject to any disclaimer, the term of this patent is extended or adjusted under 35 U.S.C. 154(b) by 261 days.

(21) Appl. No.: 12/843,707

(22) Filed: Jul. 26, 2010

(65) Prior Publication Data

US 2011/0019416 A1 Jan. 27, 2011

Related U.S. Application Data

(60) Provisional application No. 61/228,159, filed on Jul. 24, 2009.

(51) Int. Cl.
*F21V 29/00* (2006.01)
*F21V 33/00* (2006.01)
*G21C 17/00* (2006.01)

(52) U.S. Cl. ..... 362/101; 362/267; 362/249.02; 362/294; 362/373

(58) Field of Classification Search ..... 362/101, 362/267, 294, 373, 241, 427, 249.02; 376/248
See application file for complete search history.

(56) References Cited

U.S. PATENT DOCUMENTS

| | | | | |
|---|---|---|---|---|
| 5,386,355 | A * | 1/1995 | Acks | 362/267 |
| 5,800,041 | A | 9/1998 | Poggi | |
| 6,616,291 | B1 | 9/2003 | Love | |
| 7,021,801 | B2 | 4/2006 | Mohacsi | |
| 7,125,146 | B2 | 10/2006 | Willis et al. | |
| 7,175,329 | B1 | 2/2007 | Chou | |
| 7,204,602 | B2 | 4/2007 | Archer | |
| 7,267,019 | B2 * | 9/2007 | Morris et al. | 73/865.8 |
| 7,293,898 | B2 * | 11/2007 | Kumthampinij et al. | 362/294 |
| 7,303,301 | B2 | 12/2007 | Koren et al. | |
| 7,396,139 | B2 | 7/2008 | Savage | |
| 7,445,352 | B2 | 11/2008 | Lin | |
| 7,507,004 | B2 * | 3/2009 | Chen | 362/373 |
| 7,575,333 | B2 * | 8/2009 | Julia Vilarrasa | 362/101 |
| 8,172,434 | B1 * | 5/2012 | Olsson | 362/346 |
| 2006/0176686 | A1 * | 8/2006 | McVicker | 362/183 |
| 2009/0180281 | A1 | 7/2009 | Ahland, III et al. | |

* cited by examiner

*Primary Examiner* — Peggy A. Neils
(74) *Attorney, Agent, or Firm* — Eleanor M. Musick; Procopio, Cory, Hargreaves & Savitch LLP

(57) ABSTRACT

A modular light unit for illuminating a hazardous underwater environment includes a housing having a front portion with a light transmissive window and a back shell portion which enclose a layered lighting assembly. The layered lighting assembly includes a PCB with an array of LEDs mounted thereon with the LEDs in thermal communication with a bottom surface of the PCB. A thermal bridge abuts the bottom surface of the PCB on one side and a heat sink on the other. A thermally conductive potting material fills spaces between the heat sink and the back shell portion. An underwater connector provides releasable connection to an electrical cable for providing power to drive the plurality of LEDs. A quick-release mechanical fastener is attached to the housing for releasably attaching the modular light unit to a support structure installed within the hazardous underwater environment.

25 Claims, 5 Drawing Sheets

MODULAR LAMP FOR ILLUMINATING A HAZARDOUS UNDERWATER ENVIRONMENT

RELATED APPLICATIONS

This application claims the priority of U.S. Provisional Application No. 61/228,159, filed Jul. 24, 2009, which is incorporated herein by reference.

FIELD OF THE INVENTION

The present invention relates to illumination systems and more particularly to illumination systems for hazardous underwater environments, including hazards such as nuclear radiation and/or contamination or in the ocean.

BACKGROUND OF THE INVENTION

A large number of reasons exist for lighting a large underwater environment including security, safety and illumination of work surfaces. Applications include oil drilling platforms, lighting around submarines and ships and for storage pools. In all applications it is desirable to use a high-efficiency, long-lifetime light source which can provide continuous lighting with minimal maintenance. Nowhere is the need for a low maintenance lighting system more pronounced than in nuclear refueling pools, spent fuel storage pools and in nuclear reactor vessels. These structures contain water, which is used to limit the transmittal of radiation. Service of the lighting systems in these areas takes excessive time, personnel may have limited access, and their service results in exposure of the maintenance personnel to radiation.

Typically, these pools require a large number of lights for effective illumination. Traditionally, this lighting has been accomplished using 1000 W, 120 V incandescent spotlights or floodlights. These bulbs have lifetime ratings of 2,000 to 4,000 hours, and provide total light output of 17,000 lumens. At a lifetime of 4,000 hours, a particular light fixture will require 2.19 bulb changes per year, with maintenance personnel being exposed to radiation at each bulb change. A typical fuel storage pool uses 20 incandescent light fixtures. Thus, maintenance personnel may be subjected to short periods of radiation quite frequently for single bulb changes or to extended periods of exposure for "en mass" changes, if it is even possible to gain access to change the bulbs.

Inside a nuclear containment structure, water is normally contained only in the immediate area of the reactor itself, i.e., the reactor pressure vessel. However, when the reactor is shut down for a refueling outage, it is necessary to fill the entire refueling cavity with water, to limit the transmittal of radiation as the fuel is being unloaded and loaded. The reactor cavity is typically flooded only during this refueling outage period, but it is necessary during this time to make sure that the cavity is properly illuminated.

During this outage period, when maintenance is being performed on the reactor and when the fuel is being unloaded and loaded, it is costly and impractical to allocate maintenance personnel time for servicing the underwater lights. Additionally, some lamps may be installed in isolated areas where radiation flux can become quite high, such that access is available only for limited periods. The nuclear maintenance workers who are responsible for these areas are required to wear cumbersome PPE (Personal Protective Equipment) that makes high-dexterity repair work difficult or impossible. Every minute of radiation exposure is critical, excess radiation exposure is costly for plant owners, and personnel are limited in the cumulative amount of radiation exposure they can receive in a given time period. As a result of this challenging situation, in practice many of these short-lifespan lights remain failed rather than being continually serviced, often resulting in some of these critical structures being poorly illuminated. Even in areas where water is not introduced, a reliable, long-lasting light source is needed for replacement of the currently-used incandescent bulbs.

A number of underwater lights are the subjects of patents, however, for various reasons, these lights are not suitable for use in nuclear environments, either as fixed lights or as drop lights. The submersible light assemblies of Olsson et al. (U.S. Pat. No. 4,683,523, issued Jul. 28, 1987, and U.S. Pat. No. 4,996,635, issued Feb. 26, 1991) have funnel-shaped housings with flared front portions designed for fixed attachment to submersible vehicles. The light sources are quartz-halogen lamps which require heat sinks, and the lamps themselves are fully isolated from water. The housings are relatively large and cumbersome and not adjustable in direction once attached. The light produced is generally projected in a narrow beam forward from the lens. Such a construction would not be suitable for the wide angle illumination needed in a nuclear pool or for the maneuverability required for a cable-suspended drop light.

The underwater light of Poppenheimer (U.S. Pat. No. 4,574,337, issued Mar. 4, 1986) has a housing that is much larger than the small quartz-halogen lamp housed therein. The lamp is fully isolated from the water by an inner casing which is cooled by water that enters the outer housing. The light is projected forward in a generally narrow beam, resulting in the same limitations for use in nuclear applications as the lights of Olsson et al.

The high-intensity light source described by Mula (U.S. Pat. No. 5,016,151, issued May 14, 1991) has a watertight housing with a second subhousing to isolate the lamp from the water. The flared shape of the housing places limitations on the maneuverability of such a device as a drop light.

Finally, and most importantly, none of the above-described lights make provisions for rapid changeout of burned-out or damaged bulbs. The reliance on closed housing construction requires that any bulb changes be made out of the water, which is one of the main problems that must be overcome in a hazardous environment such as nuclear facility pools. Such changes are time-consuming and require multiple radiation exposures to effect a bulb replacement. Traditional incandescent underwater lamps used multiple small fasteners and sealing rings that necessitated a high level of dexterity for proper maintenance. If the entire lighting assembly were to be replaced to avoid multiple exposures, such changes could become very expensive due to the complex construction of the assemblies. Any facility which requires a large number of such light systems could find them to be prohibitively expensive to maintain High pressure sodium (HPS) lighting has been used extensively for street and parking area illumination, lighting in factories and for security lighting. The primary advantages of HPS lights are: 1) high efficiency, and 2) very long lifetime. Compared to a 1000 W incandescent bulb, an HPS bulb has a lifetime rating of 24,000 hours and provides a total light output of 140,000 lumens. U.S. Pat. No. 5,105,346, No. 5,213,410 and No. 5,386,355, each incorporated herein by reference, describe a lighting system and method for lighting hazardous underwater environments using HPS lamps in a modular configuration that provides for rapid replacement of the damaged or burned-out bulbs. The commercial version of this lighting system has received universal acceptance from major nuclear fuel manufacturers and has been installed in a large number of nuclear power plants worldwide.

One drawback of HPS lighting is that its yellow-orange color temperature (~2,200 K) is not ideal for human vision, which is optimized for white (5,500 K) light. While HPS lighting was the best option at the time the time of these patents, when using HPS lights in the underwater environment it can be difficult to discern objects and identify their true color due to the non-white color of the illumination. An additional drawback is that HPS lamps can take several minutes before reaching full intensity, which delays the user's ability to see clearly within the underwater environment in an emergency situation, if these lights were not previously turned on.

The recent emergence of ultra-bright, white, high power light emitting diodes (LEDs) presents an alternative that can overcome some of the above-described drawbacks of HPS lighting. Key characteristics of these high power LEDs are excellent reliability and durability, instant turn on, longevity and good color. Furthermore, the efficiency (increased lumens per watt) of these LEDs provides a significant reduction in power consumption and, consequently, carbon emission. However, complexities are introduced over traditional lighting sources by their need for drivers and power factor correction. Despite these advantages, the major issue that has previously prevented the adoption of LED lighting is thermal management. While typical LEDs can be operated at temperatures up to 185° C., that high of an operating temperature is not conducive to long life and low maintenance. Some LED manufacturers specify a maximum operating temperature of 85° C. to ensure 70% luminance after an operating life of 50,000 hours. Failure to address the heat dissipation needs of LED lighting will lead to severe degradation, which reduces operational lifetime, reduces visible light output, and negatively affects the color rendering.

U.S. Pat. No. 6,412,971 describes a LED array that has a large number of elements arranged with sufficient density to achieve a desired illumination intensity to replace conventional incandescent or HPS light sources without creating the environmental concerns of fluorescent bulbs. While the disclosed LED array solves many of the problems encountered with replacement of incandescent bulbs with LED arrays, it does not provide solutions for the special requirements of underwater operation, and particularly fails to address the problems involved in underwater operation in a hazardous environment such as a nuclear spent fuel pool or nuclear reactor.

Accordingly, obstacles remain to realization of LED-based lighting fixtures for use in hazardous underwater environments such as nuclear reactors and spent fuel pools. The present invention is directed to providing such fixtures.

BRIEF SUMMARY OF THE INVENTION

It is an advantage of the present invention to provide a long-life LED-based light module that can be rapidly inserted into and removed from a lighting fixture that is located in a hazardous environment.

In one aspect of the invention, a modular light unit for illuminating a hazardous underwater environment includes a housing having a front portion and a back shell portion, the front portion including a light transmissive window and a layered lighting assembly enclosed within the housing. The layered lighting assembly includes a printed circuit board comprising a dielectric layer. A plurality of electrically-conductive traces are formed on an upper surface of the dielectric layer. An array of LEDs is mounted on the printed circuit board (PCB) in electrical communication with the electrically-conductive traces. A thermal bridge abuts the underside of the PCB in thermal communication the LEDs, and a heat sink abuts the thermal bridge in thermal communication therewith. A thermally conductive potting material abuts the heat sink to fill all spaces between the heat sink and an inner surface of the back shell portion. A reflector array is disposed over an upper surface of the printed circuit board, the reflector array having a pattern corresponding to the array pattern of the LEDs so that the reflector array has a reflector corresponding to each LED of the plurality of LEDs. An underwater connector in electrical communication with the electrically-conductive traces provides releasable connection to an electrical cable for providing power to drive the plurality of LEDs. A quick-release mechanical fastener is attached to the housing for releasably attaching the modular light unit to a support structure installed within the hazardous underwater environment. In a preferred embodiment, the PCB is a metal core PCB which includes a metal base affixed to the underside of dielectric material. Where a metal core PCB is used, the metal base is preferably copper. The thermal bridge and the heat sink are preferably formed from copper and the housing is formed from stainless steel. In one embodiment, the heat sink includes a plurality of ribs that extend from a lower side of the heat sink, so that the potting material fills all spaces between the plurality of ribs and the inner surface of the back shell portion.

According to a first embodiment of the present invention, an integrated LED module and composite heat transfer mechanism, enclosed by a metal housing and an optical window. In a preferred embodiment, the housing is stainless steel, more preferably 316-type stainless steel, however other stainless steel types as well as aluminum or other metals may be used for applications where the need to support decontamination is not as critical, i.e., in non-nuclear settings. The integrated LED module includes a plurality of high power LEDs, preferably emitting white light, mounted in an array on a metal core printed circuit board (PCB). The module also includes an array of reflectors that is positioned above the PCB, with one reflector associated with each LED. A composite heat transfer assembly includes stacked components in which the metal core circuit board is bonded to a thermal bridge. Heat generated by the LEDs is transferred from the thermal bridge to the module housing via a heat sink and high-efficiency heat transfer potting compound. The potting compound is in contact with the interior surface of the housing. In a first embodiment, a heat sink with an upper surface in contact with the back surface of the thermal bridge has ribs extending from its lower surface which are surrounded by a thermally conductive potting compound. The potting compound provides heat transfer between the heat sink and the inner surface of module housing. An underwater connector attached to the housing provides electrical connection from a power supply for driving the LEDs. The heat transfer assembly maintains the LEDs at appropriate operating temperatures when the lamp is submerged in water of temperatures of 50° C. or less. This environment allows the LEDs to operate at steady-state temperatures that optimize operating life (e.g., 30,000 hours or more). The integrated LED lamp module provides output illumination that is comparable to a conventional 1000 W HPS lamp. An important advantage of the LED module is that the emitted light has a higher color temperature than HPS lamps, which provides improved visibility for human users. In addition, unlike the HPS lamps, the LED lamp is dimmable.

In a second embodiment of the integrated LED lamp module, the same components as in the first embodiment are used with a modified heat sink that does not have fins. In this embodiment, the larger volume of heat sink material provides a sufficiently uniform dispersal to minimize hot spots. The heat sink is attached by potting compound to the interior surfaces of the housing.

All lamp internals are sealed and their exposure to water is avoided through a combination of the materials and fastening means used to assemble the housing and the potting compound. The lamp mechanical design allows easy installation and removal of the entire module. By reducing the time required for installation and removal, the radiation exposure to maintenance workers is decreased and the ALARA ("As Low As Reasonably Achievable") radiation exposure minimization principle is practiced. Radiation exposure by maintenance workers is minimized due to the reduced frequency of maintenance interventions being required. All external portions of the light assembly are designed for use in hazardous environments, through the use of materials and geometries that can easily be easily decontaminated.

This easily-serviced underwater light for use in a hazardous underwater environment can be constructed using either of the above-described modular lamp constructions.

A rapid-change light module for use in a hazardous underwater environment can be constructed using either of the above-described modular lamp constructions.

DETAILED DESCRIPTION

As used in the present description, the term "LED" refers to a solid state chip or die (light emitting diode chip) that converts electricity into light as well as a packaged light emitting diode, as known in the art, which includes a LED chip, a primary lens, and a thermal pad for heat transfer from the LED chip. For some applications of the invention, LED may also include laser diodes.

Figure 1C:
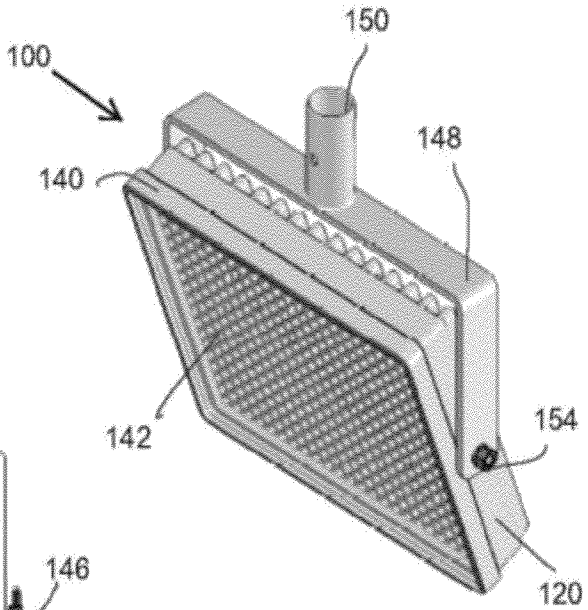
FIGS. 1*a*-1*c* are front view, side view and perspective views, respectively, of an exemplary modular light head for use in hazardous underwater environments.
Figure 1B:
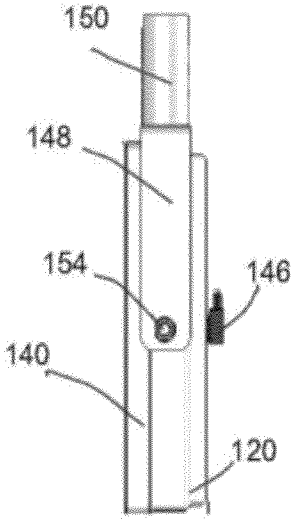
Figure 1A:
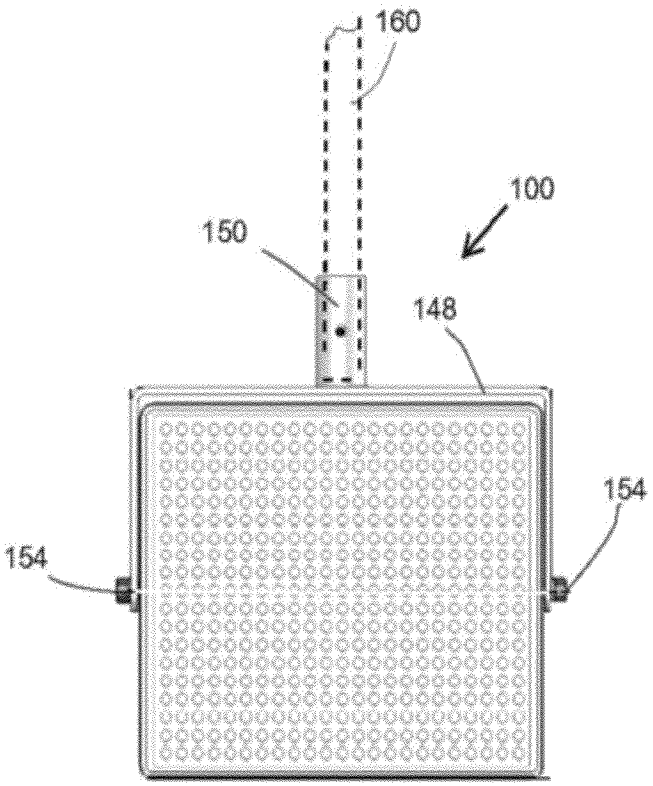

FIGS. 1*a*-1*c* illustrate an exemplary light head 100 that can be constructed using the LED-based modular lamp components that are described in more detail below. The integrated lamp module 100 includes a housing 130 formed by the combination of a rear shell 120 and a front cover 140 which includes an optical grade window. For nuclear reactor applications, the rear shell 120, and any other exposed metal used in housing 130 is preferably stainless steel. Selection of an appropriate type of stainless steel is within the level of skill in the art, and will be based on the selected material's ability to undergo decontamination procedures without excessive surface damage or structural degradation. In the preferred embodiment, type 316 stainless steel is used. For non-nuclear applications, appropriate metals may include other types of stainless steel, aluminum or other metals. As seen in FIG. 1*c*, fins or ribs may be formed to extend away from the rear shell to enhance heat dissipation from the module.

Figure 2:
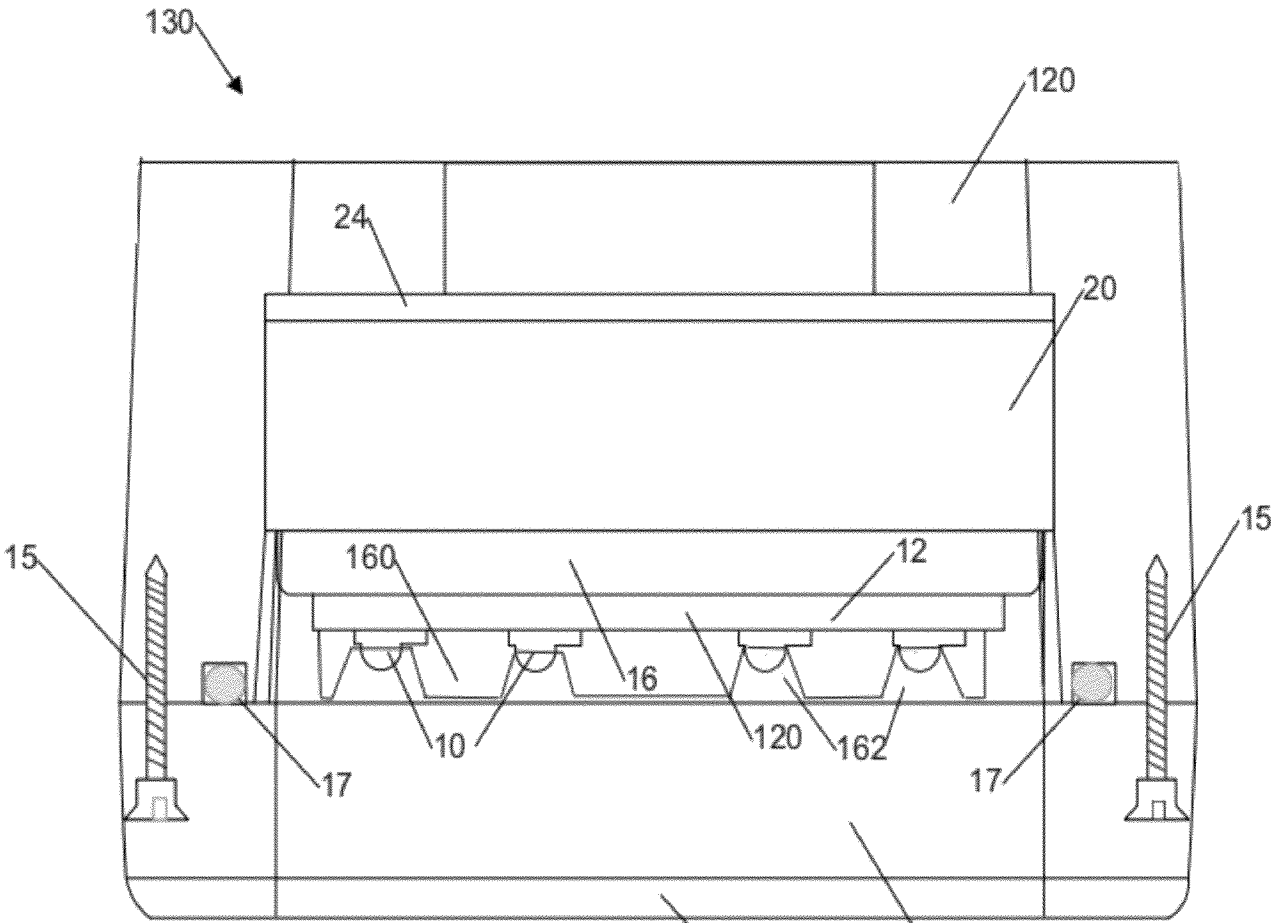
FIG. 2 is a cross-sectional view of a LED-based light module according to the present invention.

Visible through, and enclosed by the optical grade window 142 of front cover 140, is a LED array and a reflector array, which are described in more detail below. In one embodiment, the optical grade window 142, typically made from acrylic or other polymer suitable for the intended application, is a flat plate sealed to a frame around its edges to complete a water-tight enclosure when assembled to rear shell 120. In this case, the frame and window together define the front portion 140 of housing 130. The frame may be formed from the same metal as the rear shell 120, e.g., type 316 stainless steel, or may be formed from the same material as the window. Alternatively, the frame and window may integrally formed by machining or molding a single piece of acrylic (or other appropriate light-transmitting material). In any of these configurations, the front portion 140 may be attached to the back portion 120 by bolts, screws or other appropriate fasteners. Screws 15 are shown in FIG. 2 as an example. One or more O-rings 17 (one is shown in FIG. 2) may be located in channels formed in one or both of the abutting edges or surfaces of the back shell 120 and front cover 140 to ensure a watertight seal.

An underwater connector 146 may be located on the back, as shown in FIG. 1*b*, or a side of the housing 130, with appropriate internal connections (not shown) to the PCB to conduct power to the light-emitting elements. In a preferred embodiment, the connector will be wet-mateable. Such connectors are commercially-available from a number of sources including Sub-Conn Inc. (North Pembroke, Mass.) and Bowtech Products, Ltd. (Aberdeen, UK), among others. Appropriate connectors should be made from materials that tolerate radiation exposure. Connector 146 provides electrical communication with a corresponding connector disposed at the end of a cable (not shown) which is electrically connected to an external power source that is appropriate for driving the lighting module. In one embodiment, the housing 130 may be attached via pivoting fasteners 154 to a bail or yoke 148 to allow adjustment of the angle of illumination. The fasteners will preferably have a locking capability to stabilize the lighting module once the desired angle has been achieved. Such fasteners are known in the art. Yoke 148 has a socket 150 and a quick release mechanical fastener, e.g., a hole for mating with a spring-biased button, or a bayonet mounting on the end of a pole 160 (indicated by dashed lines in FIG. 1*a*). The quick release fastener allows the entire modular assembly 100 to be rapidly attached to or removed from a pole, similar to the one shown in FIG. 1 of U.S. Pat. No. 5,386,355, which is incorporated herein by reference. (The ballast illustrated in the '355 patent would not be required.) While any number of quick-release attachment means may be used, employing the same connectors that are used in a pre-existing installation has the advantage that the LED-based modular lighting assembly can easily replace existing HPS fixtures similar to those described in the '355 patent. In this application, the ballast assembly shown in the HPS fixture could be replaced by a LED driver, which may be enclosed in a watertight housing in a configuration similar to the ballast shown in the '355 patent. Alternatively, the LED driver(s) may be included within the housing of the modular light assembly 100. The ability to attach the inventive LED-based light module to an existing pole installation that may have been previously used with a HPS fixture will further assist in minimizing radiation exposure of maintenance personnel. After removal of the lamp module 100, the module may be taken to a maintenance shop for decontamination and replacement of damaged or spent LEDs by opening the housing, removing the entire internal assembly, and replacing it with a new internal assembly.

Figure 3:
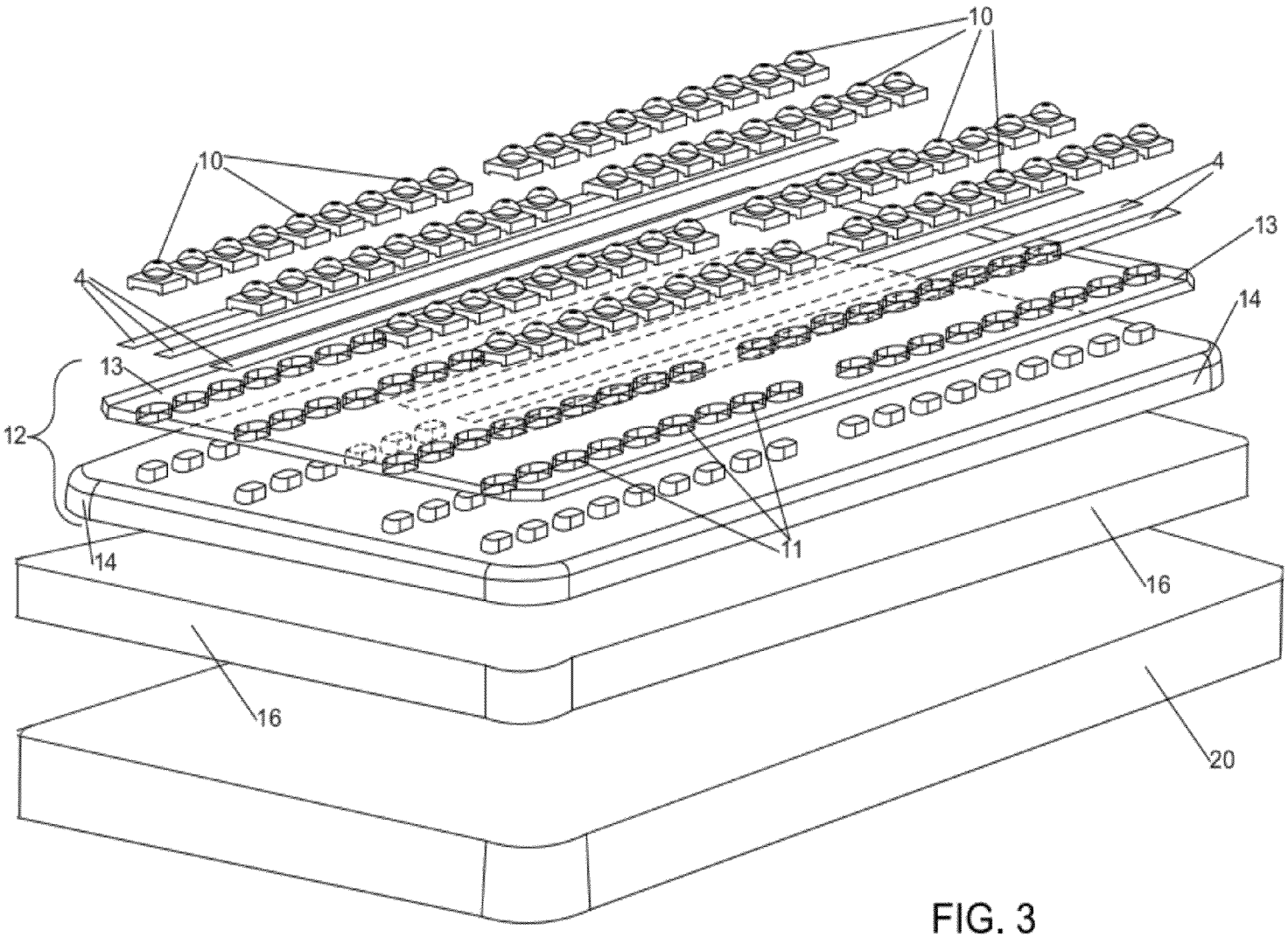
FIG. 3 is an exploded perspective view of the LEDs, PCB and thermal management assembly according to a first embodiment of the invention.

Referring to FIGS. 2 and 3, the internal assembly of the integrated LED lamp is shown and includes a plurality of LEDs 10 mounted in an array on a printed circuit board (PCB) 12. Exemplary illustrations of different array patterns of LEDs are shown in FIGS. 1*a* and 1*c*, and FIG. 3. Typical numbers of LEDs in an array can range from several dozen, e.g., 80 LEDs in the exemplary 4×20 array of FIG. 3, to several hundreds, as in the 437 LEDs in the exemplary 19×23 array in FIGS. 1*a* and 1*c*. More or fewer LEDs may be used, and other patterns may be selected based on specific lighting requirements for the desired application and the light output of the individual LEDs. Selection of appropriate LED numbers and arrangements is within the level of skill in the art. A plurality of copper traces 4 printed on the upper surface of the PCB 12 serve as the electrical connection to each of the LEDs for delivering power for operation.

In the preferred embodiment, PCB 12 is a metal core board (MCPCB). FIG. 3 illustrates the structure of the MCPCB, which is formed by laminating a thermally conductive dielectric layer 13, e.g., G10 epoxy or similar, and a high thermal conduction metal base 14. In the preferred embodiment, the metal base 14 is copper, although aluminum or other metals may be used. Openings 11 formed through dielectric layer 13 allow direct contact between the LED thermal pads and metal base 14 for optimal heat conduction. As illustrated in FIG. 3, the metal base has small pedestals formed on its upper surface to extend though the openings 11 in the dielectric layer 13 to contact the thermal pad of the LEDs. An alternative approach would be to make the openings 11 of a size and shape sufficient to allow the thermal pad of the LED to extend through the dielectric layer to directly contact the flat upper surface of the metal base 14. An example of this approach is described in U.S. Pat. No. 7,262,438 of Mok et al., which is incorporated herein by reference. In either approach, the thermal pad of the LED may be attached to the metal base 14 by a thermally conductive bonding agent.

In yet another alternative embodiment, the PCB 12 may omit the metal core, in which case the PCB could be formed from FR-4, which is known in the art. In this embodiment, the PCB would be formed in a manner similar to that described by Mok et al., and as illustrated in FIG. 3, however, the thermal pads of the LEDs 10 would extend through the PCB 12 to contact the upper surface of the thermal bridge 16.

Thermal bridge 16 uniformly conducts the heat from the LEDs 10 toward heat sink 20. To avoid creation of hot spots, PCB metal base 14 (if used), thermal bridge 16 and heat sink 20 preferably have uniform, flat contact surfaces. To achieve the desired flatness, both thermal bridge 16 and heat sink 20 may be formed by milling metal bar stock. The bar stock should be of relatively high purity without inclusions to enhance uniform conduction. In the preferred embodiment, both the thermal bridge and heat sink are formed from copper, but other thermally conductive metals and alloys may be used as appropriate for the type of LEDs used and the particular lighting application. The thermal bridge 16 may be attached directly to the base of the MCPCB 12 by a thermally conductive adhesive, thus eliminating the need for multiple heat sinks on top of the surface mounted components. Use of a thermally conductive adhesive between the different contact surfaces may be able to compensate for minor variations in surface flatness, however, in general, the adhesive will preferably have a uniform thickness, again to avoid creation of potential hot spots.

Figure 4:
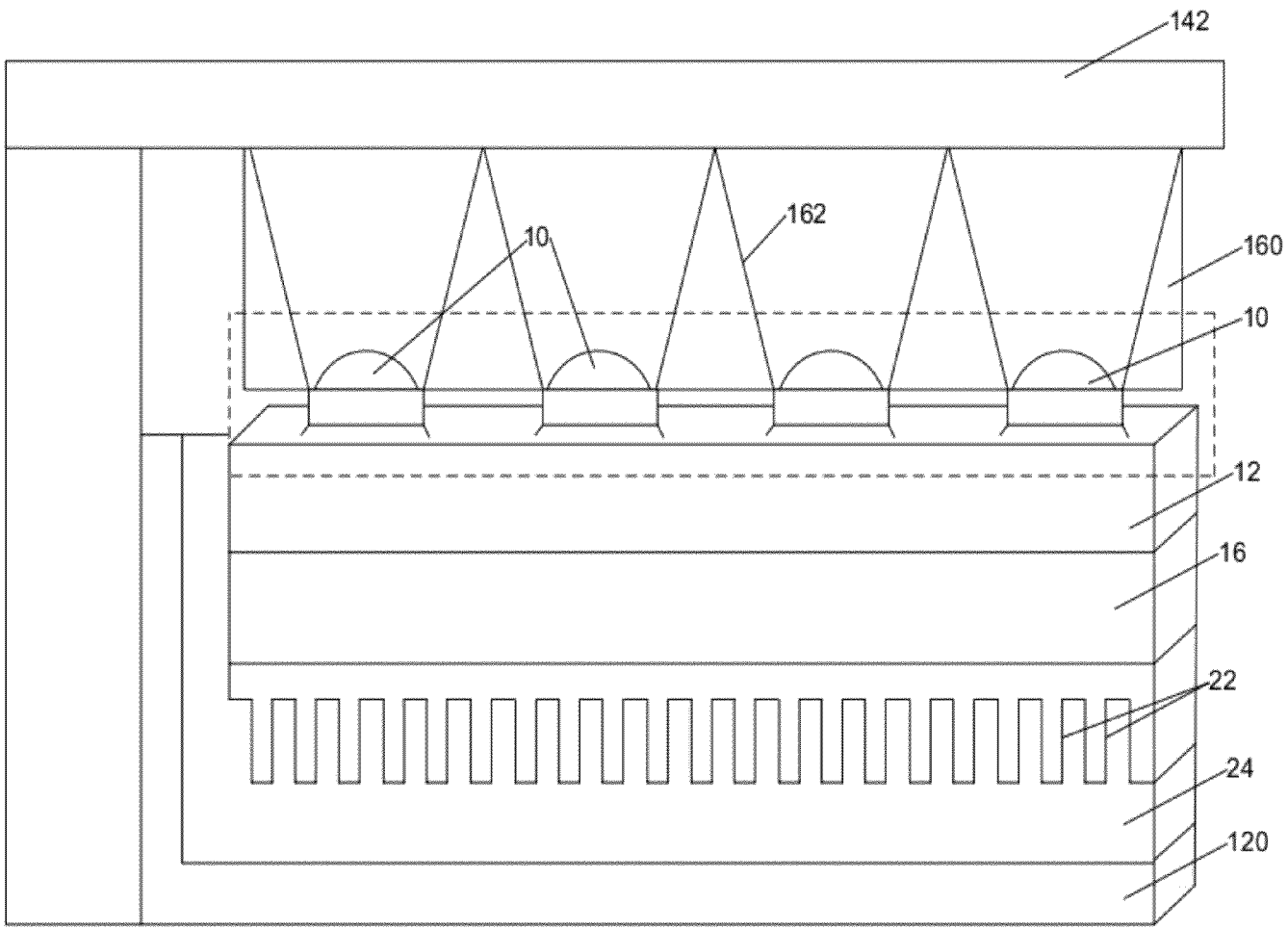
FIG. 4 is a diagrammatic view of a cross-section of the first embodiment of a LED-based modular lighting assembly.

Heat sink 20, which abuts the back side of thermal bridge 16, conducts the heat transferred from the packaged LED through the PCB 12 and thermal bridge to the back shell 120 of housing 130. In the first embodiment shown in FIG. 4, the heat sink 20 may include a plurality of ribs 22 extending from its back side (the side opposite the front portion of the module). The spaces between the ribs 22, as well as any spaces between the ribs and the inner surface of the back shell 120, are filled with a high heat transfer potting compound 24. Such compounds are commercially-available from a number of sources, including Durapot™ 810, an alumina based, thermally conductive potting compound and adhesive available from Contronics Corp. (Brooklyn N.Y.).

Figure 5:
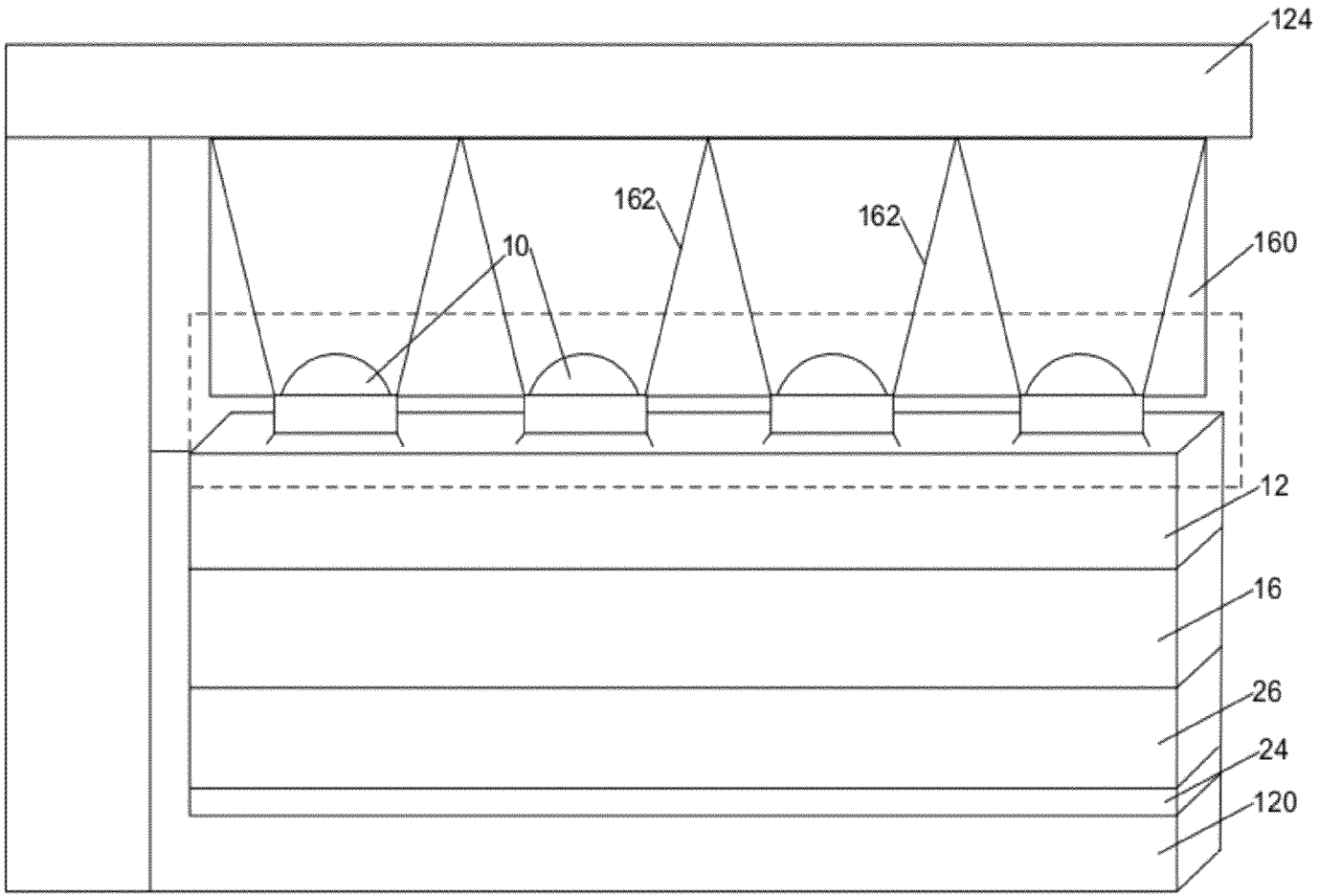
FIG. 5 is a diagrammatic view of a cross-section of an alternative embodiment of an LED-based modular lighting assembly.

In a second embodiment shown in FIG. 5, the heat sink 26 is formed as a solid block, without ribs. A high heat transfer potting compound 24 fills the space between a solid heat sink 24 and the inner surface of back shell 120.

A reflector array 160 with a plurality of conical or parabolic reflectors 162 is positioned over the front face of the PCB 12. The number of reflectors 162 and their spacing match that of the LED array so that when the reflector array and LED array are aligned, each LED 10 is centered within the bottom opening of its corresponding reflector to maximize the amount of light that is directed through the window.

The LED lighting system described above can be maintained at its safe operating temperature when the lamp is subjected to water temperatures of 50° C. or lower. When operated within its safe operating temperature, the inventive LED lighting system will achieve an average of 50,000 life hours. The integrated LED lamp provides an output illumination comparable to conventional 1000 W HPS lamps while providing a higher color temperature than conventional HPS lamps.

The modular design of the inventive lighting system allows easy installation and removal. When used in nuclear reactors, the time required for installation or removal is minimized, decreasing radiation exposure to RAD workers and promoting the ALARA (As Low As Reasonably Achievable) principle.

For ease of description, elements of the invention have been described herein as having "upper" and "lower", "front" and "back" sides or surfaces. These and other position-related adjectives are intended to indicate relative location only in the layered assembly and are not intended to limit the invention to use in a particular orientation. Thus, for example, reference to the upper surface of a printed circuit board means the surface on which electrical components (LEDs) are attached, as illustrated in FIGS. 2-5. This does not mean that the PCB will only be used in a horizontal orientation with the LEDs facing upward, as will be readily apparent from FIGS. 1*a*-1*c*.

The foregoing description of preferred embodiments is not intended to be limited to the specific details disclosed herein. Rather, the present invention extends to all functionally equivalent structures, methods and uses as fall within the scope of the appended claims.

The invention claimed is:

1. A modular light unit for illuminating a hazardous underwater environment, comprising:

a housing having a front portion and a back shell portion, the front portion including a light transmissive window;

a layered lighting assembly enclosed within the housing, the layered lighting assembly comprising:

a printed circuit board comprising a dielectric layer having a lower surface, wherein a plurality of electrically-conductive traces is formed on an upper surface of the dielectric layer;

a plurality of LEDs in electrical communication with the plurality of electrically-conductive traces and in thermal communication with the lower surface of the printed circuit board, wherein the plurality of LEDs are arranged in an array pattern;

a thermal bridge abutting the lower surface of the printed circuit board in thermal communication therewith;

a heat sink abutting the thermal bridge in thermal communication therewith;

a thermally conductive potting material abutting the heat sink to fill all spaces between the heat sink and an inner surface of the back shell portion;

a reflector array disposed over an upper surface of the printed circuit board, the reflector array having a pattern corresponding to the array pattern of the LEDs, wherein the reflector array has a reflector corresponding to each LED of the plurality of LEDs;

an underwater connector in electrical communication with the electrically-conductive traces for releasable connection to an electrical cable for providing power to drive the plurality of LEDs; and a quick-release mechanical fastener attached to the housing for releasably attaching the modular light unit to a support structure installed within the hazardous underwater environment.

2. The modular light unit of claim 1, wherein the printed circuit board further comprises a metal base disposed on the lower surface of the dielectric layer.

3. The modular light unit of claim 2, wherein each of the metal base is formed from copper.

4. The modular light unit of claim 2, wherein each of the thermal bridge and the heat sink is formed from copper.

5. The modular light unit of claim 1, wherein the housing is formed from stainless steel.

6. The modular light unit of claim 1, wherein the front portion and the back shell portion are attached together to form a watertight seal.

7. The modular light unit of claim 1, wherein the heat sink comprises a plurality of ribs extending from a lower side of the heat sink, and the potting material fills all spaces between the plurality of ribs and the inner surface of the back shell portion.

8. The modular light unit of claim 1, further comprising a yoke pivotably attached to the housing, wherein the yoke comprises a quick-release connector for attachment to a support structure mounted within the hazardous underwater environment.

9. The modular light unit of claim 1, wherein the underwater connector is a wet-mateable connector.

10. A modular light unit for illuminating a hazardous underwater environment, comprising:

a housing having a front portion and a back shell portion, the front portion including a light transmissive window;

a yoke pivotably attached to the housing, wherein the yoke comprises a quick-release connector for attachment to a support structure mounted within the hazardous underwater environment;

a layered lighting assembly enclosed within the housing, the layered lighting assembly comprising:

a printed circuit board comprising a dielectric layer having a lower surface, wherein a plurality of electrically-conductive traces is formed on an upper surface of the dielectric layer;

a plurality of LEDs in electrical communication with the plurality of electrically-conductive traces and in thermal communication with the lower surface of the printed circuit board, wherein the plurality of LEDs are arranged in an array pattern;

a thermal bridge abutting the lower surface of the printed circuit board in thermal communication therewith;

a heat sink abutting the thermal bridge in thermal communication therewith;

a thermally conductive potting material abutting the heat sink to fill all spaces between the heat sink and an inner surface of the back shell portion; and an underwater connector in electrical communication with the electrically-conductive traces for releasable connection to an electrical cable associated with the support structure for providing power to drive the plurality of LEDs.

11. The modular light unit of claim 10, wherein the printed circuit board comprises a metal core printed circuit board having a thermally conductive metal base affixed to the lower surface of the dielectric layer.

12. The modular light unit of claim 11, wherein the metal base is formed from copper.

13. The modular light unit of claim 10, wherein each of the thermal bridge and the heat sink is formed from copper.

14. The modular light unit of claim 10, wherein the housing is formed from stainless steel.

15. The modular light unit of claim 10, wherein the front portion and the back shell portion are attached together to form a watertight seal.

16. The modular light unit of claim 10, wherein the heat sink comprises a plurality of ribs extending from a lower side of the heat sink, and the potting material fills all spaces between the plurality of ribs and the inner surface of the back shell portion.

17. The modular light unit of claim 10, wherein the layered lighting assembly further comprises a reflector array disposed over an upper surface of the printed circuit board, the reflector array having a pattern corresponding to the array pattern of the LEDs, wherein the reflector array has a reflector corresponding to each LED of the plurality of LEDs.

18. The modular light unit of claim 10, wherein the underwater connector is a wet-mateable connector.

19. A rapid-changeout light assembly for attachment to and removal from a support structure disposed within a hazardous underwater environment, comprising:

a housing having a front portion and a back shell portion, the front portion including a light transmissive window;

a yoke pivotably attached to the housing, wherein the yoke comprises a quick-release connector for attachment to the support structure;

a layered lighting assembly enclosed within the housing, the layered lighting assembly comprising:

a printed circuit board comprising a dielectric layer disposed on a thermally-conductive metal base, wherein a plurality of electrically-conductive traces is formed on an upper surface of the dielectric layer;

an array of LEDs in electrical communication with the plurality of electrically-conductive traces and in thermal communication with the metal base;

a thermal bridge abutting the metal base in thermal communication therewith;

a heat sink abutting the thermal bridge in thermal communication therewith;

a thermally conductive potting material abutting the heat sink to fill all spaces between the heat sink and an inner surface of the back shell portion;

a reflector array disposed over an upper surface of the printed circuit board, the reflector array corresponding to the array of the LEDs so that the reflector array has a reflector corresponding to each LED of the array of LEDs and an underwater connector in electrical communication with the electrically-conductive traces for releasable connection to an electrical cable associated with the support structure for providing power to drive the plurality of LEDs.

20. The rapid-changeout light assembly of claim 19, wherein the metal base is formed from copper.

21. The rapid-changeout light assembly of claim 19, wherein each of the thermal bridge and the heat sink is formed from copper.

22. The rapid-changeout light assembly of claim 19, wherein the housing is formed from stainless steel.

23. The rapid-changeout light assembly of claim 19, wherein the front portion and the back shell portion are attached together to form a watertight seal.

24. The rapid-changeout light assembly of claim 19, wherein the heat sink comprises a plurality of ribs extending from a lower side of the heat sink, and the potting material fills all spaces between the plurality of ribs and the inner surface of the back shell portion.

25. The modular light unit of claim 19, wherein the underwater connector is a wet-mateable connector.

* * * * *